US006242705B1

(12) United States Patent
Huang

(10) Patent No.: US 6,242,705 B1
(45) Date of Patent: Jun. 5, 2001

(54) KEYSWITCH

(75) Inventor: Gear Huang, Taipei (TW)

(73) Assignee: Silitek Corporation, Taipei (TW)

( * ) Notice: Subject to any disclaimer, the term of this patent is extended or adjusted under 35 U.S.C. 154(b) by 0 days.

(21) Appl. No.: 09/536,797

(22) Filed: Mar. 28, 2000

(51) Int. Cl.[7] ..... H01H 13/14; H01H 13/705
(52) U.S. Cl. ..... 200/520; 200/341; 200/345
(58) Field of Search ..... 210/341, 344, 210/345, 520, 521, 517, 342, 343

(56) References Cited

U.S. PATENT DOCUMENTS 4,939,324 * 7/1990 English ..... 200/345
5,201,824 * 4/1993 Kato et al. ..... 200/520
5,670,759 * 9/1997 Hsu ..... 200/345 X
5,938,009 * 8/1999 Huang ..... 200/517
6,121,564 * 9/2000 Huang ..... 200/345

* cited by examiner

*Primary Examiner*—J. R. Scott
(74) *Attorney, Agent, or Firm*—Rosenberg, Klein & Lee

(57) ABSTRACT

An improved keyswitch includes a stage having a mounting hole and a keycap having a plunger on a bottom thereof. The plunger is movably arranged within the mounting hole. The keyswitch is characterized in that one of the keycap and the stage is provided with at least one guiding rib, while the other of the keycap and the stage is provided with at least one dent corresponding to the guiding rib. The guiding rib is fit within the dent and the dent and guiding rib have multiple point contacts to restrict movement of the keycap with respect to the stage.

2 Claims, 5 Drawing Sheets

KEYSWITCH

FIELD OF THE INVENTION

The present invention relates to an improved keyswitch, especially to an improved keyswitch without using a scissors structure and having tactile effect like keyswitch using a scissors structure.

BACKGROUND OF THE INVENTION

The scissors structure comprising two levers is widely used in keyswitch, wherein the keycap is guided by the scissors structure to move upward and downward, and the. The rubber cone below the keycap is risen or collapsed to switch a circuit board on bottom of the keyswitch. The keyswitch using scissors structure has the advantages of excellent tactile effect and compact size. However, the manufacture cost is high.

It is an object of the present invention to provide an improved keyswitch wherein the keycap has restrict vertical movement within the stage, thus having more stability.

It is another object of the present invention to provide an improved keyswitch, which does not involve a scissors structure and has excellent tactile effect, thus providing compact and low-cost keyboard.

To achieve the above objects, in the inventive keyswitch, one of the keycap and the stage is provided with at least one guiding rib, another one of the keycap and the stage is provided with at least one dent corresponding to the guiding rib. The guiding rib is fit within the dent and the dent and guiding rib have multiple point contact to restrict vertical movement of the keycap within the stage.

The various objects and advantages of the present invention will be more readily understood from the following detailed description when read in conjunction with the appended drawing, in which:

DETAILED DESCRIPTION OF PREFERRED EMBODIMENT

Figure 1:
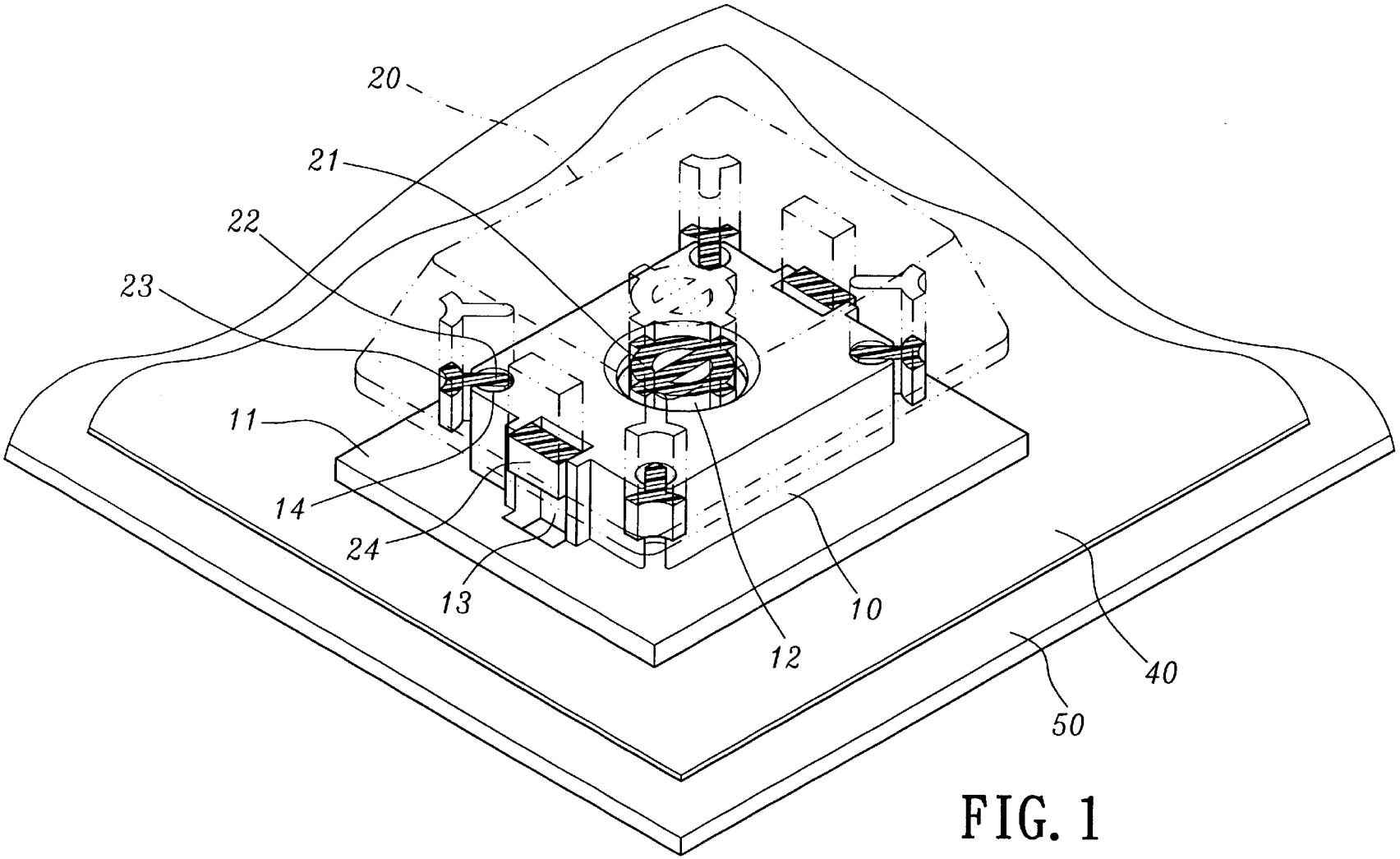
FIG. 1 is a perspective view of the present invention.
Figure 2:
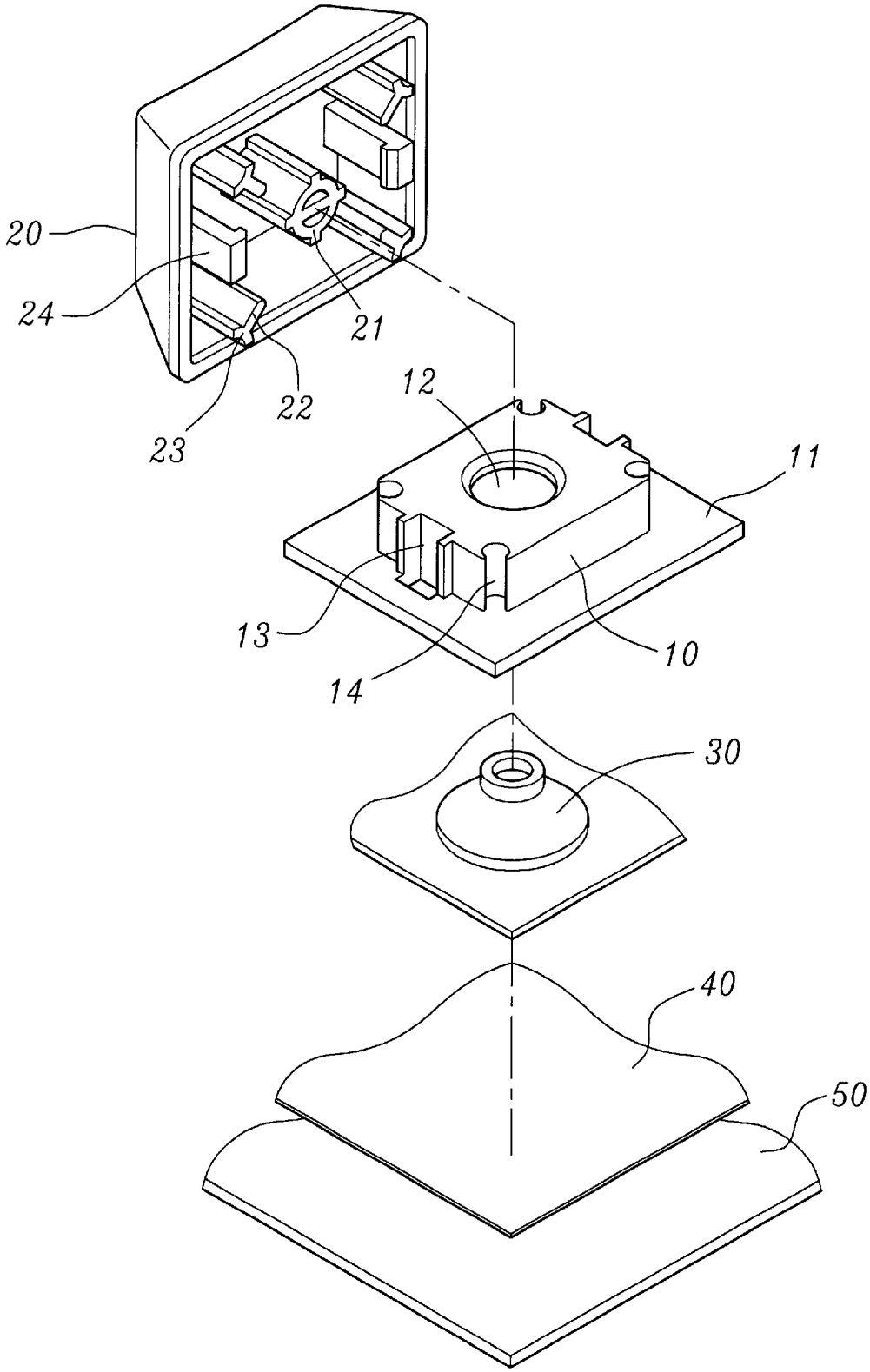
FIG. 2 is an exploded view of the present invention.

FIGS. 1 and 2 show a preferred embodiment of the present invention, the keyswitch comprises a stage 10 and a keycap 20. The stage 10 is a hollow cylinder and formed on a base 11. The stage 10 has a mounting hole 12 on center thereof and two clamping grooves 13 on two opposed sides thereof. The stage 10 has at least one dent 14 on outer lateral side thereof. In this preferred embodiment of the present invention, the stage 10 has four dents 14 on four comers thereof, each dent 14 has open top and lateral side.

Figure 3:
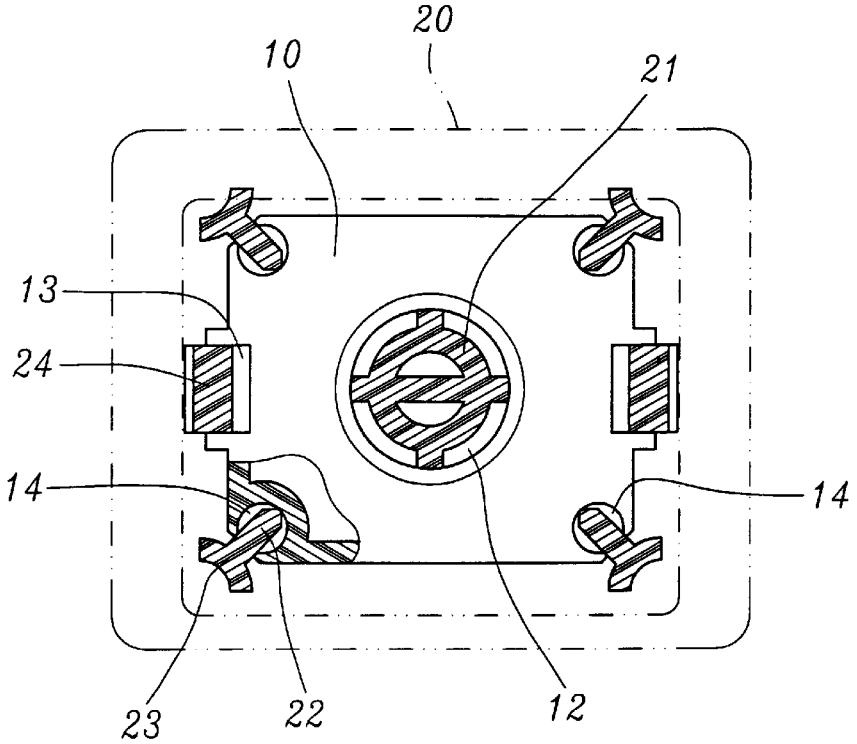
FIG. 3 is a longitudinal sectional view of the present invention.

The keycap 20 has a plunger 21 on bottom side thereof and movably arranged within the mounting hole 12. The keycap 20 has two clamping poles 24 movably arranged within the clamping grooves 13 on two opposed sides of the stage 10. The keycap 20 has at least one guiding rib 22 corresponding to the dent 14. In this preferred embodiment of the present invention, the keycap 20 has four guiding ribs 22 of plate shape. The front end of the guiding rib 22 can be modified and the rear end of the guiding rib 22 has a reinforcing fork 23. As shown in FIG. 3, the guiding rib 22 is fit within the dent 14. The keyswitch is arranged atop the rubber cone 30, the flexible circuit 40 and the base plate 50.

Figure 5:
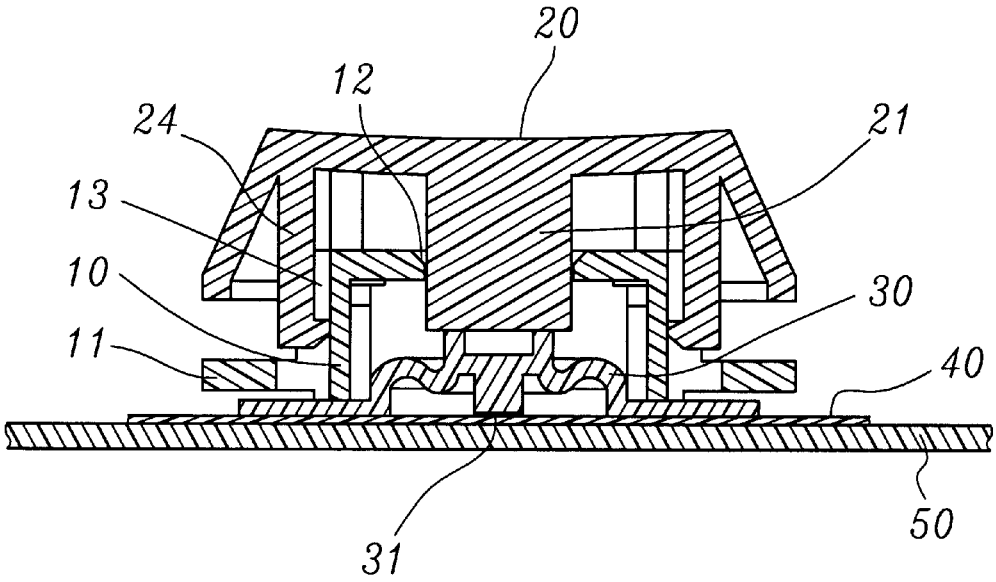
FIG. 5 depicting the pressing operation of keyswitch of the present invention.

As shown in FIG. 5, when the keycap 20 is pressed to lower down the plunger 21, the pressing end 31 of the rubber cone 30 touches the flexible circuit 40 on the base plate 50 to switch on the flexible circuit 40.

Figure 4:
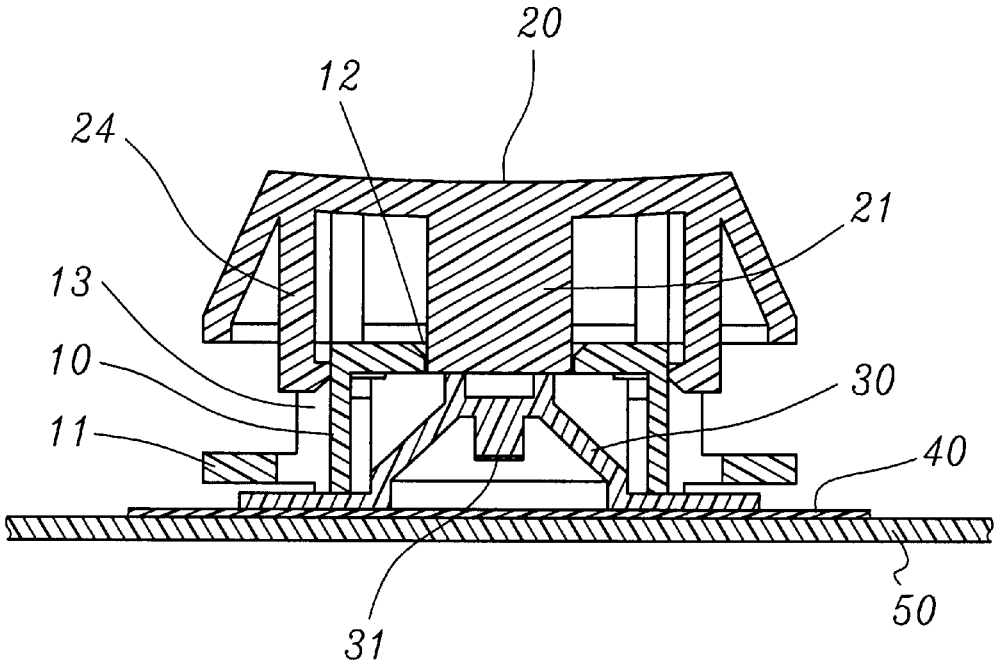
FIG. 4 is a transverse sectional view of the present invention.

As shown in FIG. 4, when the keycap 20 is released, the pressing end 31 of the rubber cone 30 leaves the flexible circuit 40 due to the elasticity of the rubber cone 30, thus switching off the flexible circuit 40.

The present invention is characterized in that concave dent 14 and convex guiding rib 22 are provided between the stage 10 and the keycap 20. The front end of the guiding rib 22 is such modified that the guiding rib 22 has multiple points contact with the dent 14. Therefore, the concave dent 14 and convex guiding rib 22 can restrict vertical movement of the keycap 20 within the stage 10.

Figure 7:
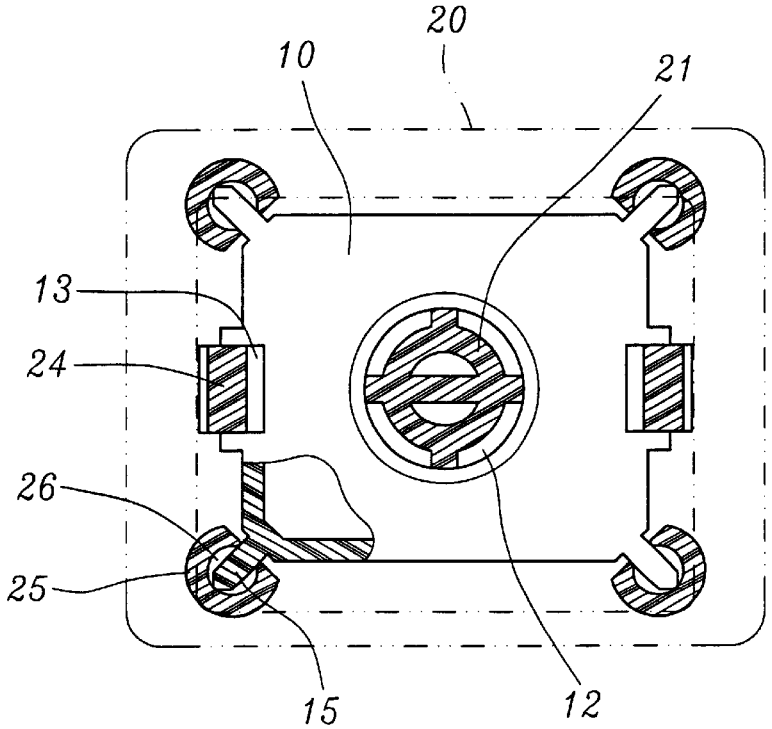
FIG. 7 is a transverse sectional view of another preferred embodiment of the present invention.
Figure 6:
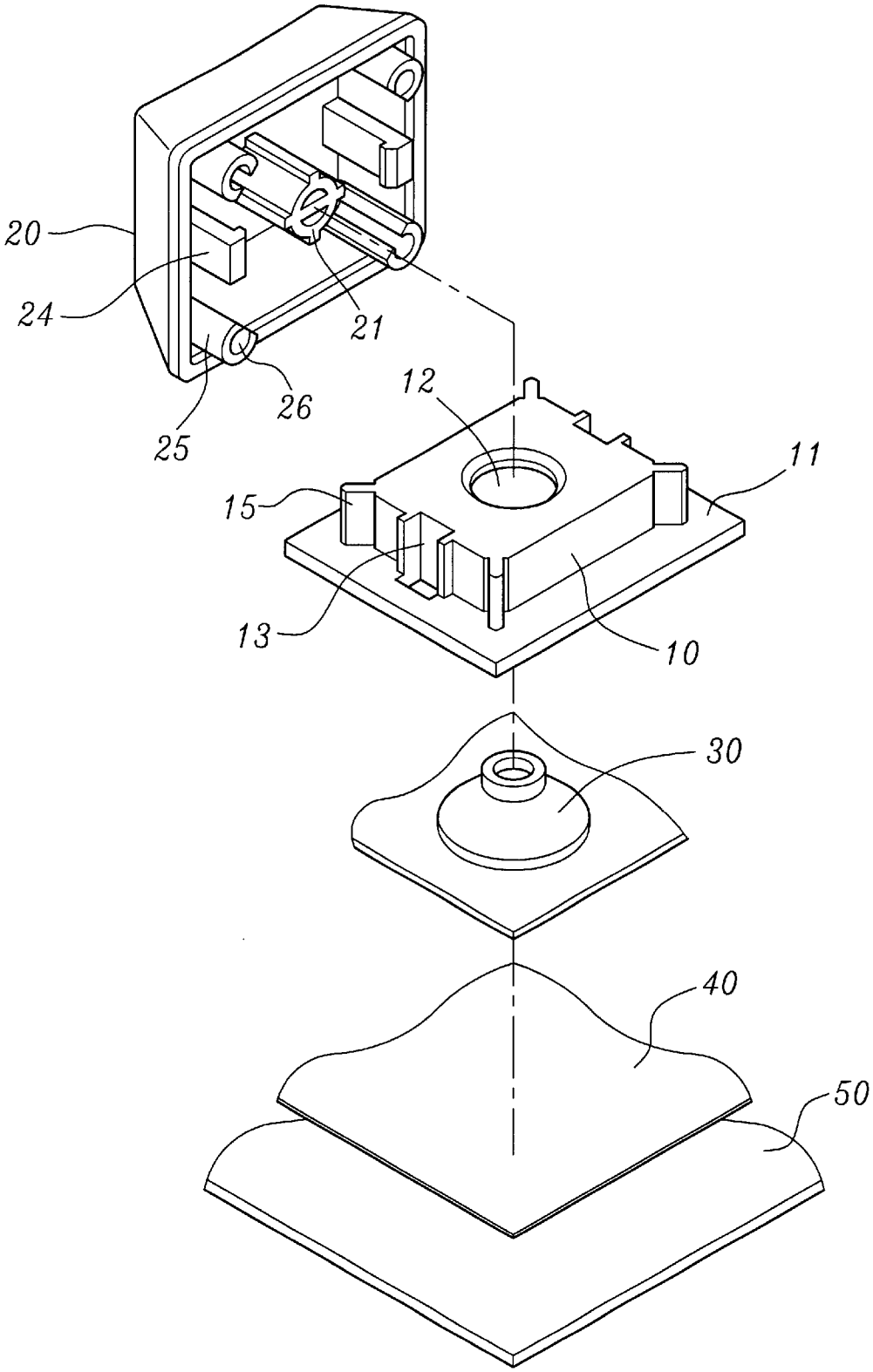
FIG. 6 is an exploded view of another preferred embodiment of the present invention.

FIGS. 6 and 7 show another preferred embodiment of the present invention, in the keyswitch, the stage 10 has at least one guiding rib 15. In this preferred embodiment of the present invention, the stage 10 has four guiding ribs 15 on four corners thereof. The keycap 20 has at least one guiding pole 25 each having a dent 26 corresponding to the guiding rib 15. In this preferred embodiment of the present invention, the keycap 20 has four dents 26, each dent 26 has open top and lateral side. The present invention is characterized in that concave dent 26 and convex guiding rib 15 are provided between the stage 10 and the keycap 20. The front end of the guiding rib 15 is such modified that the guiding rib 15 has multiple points contact with the dent 26. Therefore, the concave dent 26 and convex guiding rib 15 can restrict vertical movement of the keycap 20 within the stage 10.

To sum up, in the present invention, the provision of the concave dent and convex guiding rib can restrict vertical movement of the keycap within the stage. The stability of the keyswitch operation is enhanced without shaking problem. The inventive keyswitch does not involves scissors structure, the manufacturing cost is reduced while the compact advantage is preserved.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A keyswitch comprising:

a base plate;

a flexible circuit overlaying said base plate;

a rubber cone disposed on said flexible circuit, said rubber cone having a pressing end extending from an internal surface thereof and spaced from said flexible circuit;

a hollow stage disposed on said flexible circuit, said stage having (a) a cavity into which said rubber cone is received, (b) a mounting hole formed through an upper surface thereof in open communication with said cavity and in aligned relationship with an upper end of said rubber cone, and (c) a plurality of vertically directed dents formed at corner portions of said stage, each dent having an open top end and lateral side; and, a keycap vertically displaceably disposed over said stage, said keycap having a plunger extending from a bottom surface thereof and passing through said mounting hole for contacting said upper end of said rubber cone, said keycap having a plurality of plate-shaped guiding ribs extending from said bottom surface and respectively disposed in aligned relationship with said plurality of dents, each said guiding rib extending through said open lateral side of a corresponding dent and having a front end shaped to provide a multipoint contact between said guiding rib and said corresponding dent, each said guiding rib having a rear end with a fork-shaped contour to provide reinforcement for said guiding rib.

2. A keyswitch comprising:

a base plate;

a flexible circuit overlaying said base plate;

a rubber cone disposed on said flexible circuit, said rubber cone having a pressing end extending from an internal surface thereof and spaced from said flexible circuit;

a hollow stage disposed on said flexible circuit, said stage having (a) a cavity into which said rubber cone is received, (b) a mounting hole formed through an upper surface thereof in open communication with said cavity and in aligned relationship with an upper end of said rubber cone, and (c) a plurality of plate-shaped guiding ribs extending from corner portions of said stage; and, a keycap vertically displaceably disposed over said stage, said keycap having a plunger extending from a bottom surface thereof and passing through said mounting hole for contacting said upper end of said rubber cone, said keycap having a plurality of vertically directed concave dents extending from said bottom surface and respectively disposed in aligned relationship with said plurality of guiding ribs, each dent having an open end and lateral side, each said guiding rib extending through said open lateral side of a corresponding dent and having a front end shaped to provide a multipoint contact between said guiding rib and said corresponding dent.

* * * * *